US006032618A

United States Patent [19]

Ferrari et al.

[11] Patent Number: 6,032,618

[45] Date of Patent: Mar. 7, 2000

[54] COOLING SYSTEM FOR A MOTOR-VEHICLE ENGINE

[75] Inventors: Andrea Ferrari; Marco Mazzeri, both of Orbassano, Italy

[73] Assignee: C.R.F. Societa Consortile Per Azioni, Turin, Italy

[21] Appl. No.: 09/123,470

[22] Filed: Jul. 28, 1998

[30] Foreign Application Priority Data

Aug. 1, 1997 [IT] Italy ..... TO97A0702

[51] Int. Cl.[7] ..... F01P 7/14

[52] U.S. Cl. ..... 123/41.1; 123/41.44; 123/406.55

[58] Field of Search ..... 123/357, 436, 123/406.55, 41.1, 41.44

[56] References Cited

U.S. PATENT DOCUMENTS 4,559,907 12/1985 Hayashi ..... 123/41.44

*Primary Examiner*—Noah P. Kamen

*Attorney, Agent, or Firm*—Sughrue, Mion, Zinn, Macpeak & Seas, PLLC

[57] ABSTRACT

A cooling system for an internal combustion engine has temperature sensors including at least one sensor for the temperature of the cooling fluid and at least one sensor for the temperature of the metal body of the engine. Both sensors are used for controlling the cooling of the engine and for controlling the fuel injection and the engine ignition.

6 Claims, 2 Drawing Sheets

COOLING SYSTEM FOR A MOTOR-VEHICLE ENGINE

BACKGROUND OF THE INVENTION

The present invention relates to cooling systems for motor-vehicle engines, of the type comprising:

- a circuit for circulation of a cooling fluid through the engine,
- a radiator,
- conduits for directing the cooling fluid coming out of the engine to the radiator and from the latter to the inlet of the engine cooling circuit,
- a pump interposed in the said conduits, for activating circulation of the cooling fluid within the circuit,
- a temperature sensors associated with the cooling circuit of the engine, comprising at least one sensor of the temperature of the cooling fluid,
- a regulator for regulating the flow of the cooling fluid through the radiator, and
- a control device for controlling said regulator on the basis of the signal emitted by said sensor.

SUMMARY OF THE INVENTION

The object of the present invention is that of providing a simple and efficient system for controlling both the cooling of the engine and also the operation of the engine itself.

In view of achieving this object, the cooling system according to the invention is mainly characterized in that said sensor further comprises at least one sensor of the temperature of the metal body of the engine, as well as in that said control device is adapted to control also the fuel injection and the engine ignition on the basis of the signals coming from said sensors (16, 17) of the temperature of the engine cooling fluid and the temperature of the engine metal body.

Due to the above mentioned feature, on one hand a more efficient cooling of the engine is obtained, since the system is able to respond more promptly during the transient operating conditions of the engine. On the other hand, the information coming from the sensors of the temperature of the engine metal body are also used for controlling the fuel infection and the engine ignition more efficiently.

The system according to the invention is further particularly adapted to be used in association with a cooling system which includes a pump adapted to be regulated, such as an electrically driven pump, in particularly a pump which can be deactivated during operation of the engine, in order to regulate the cooling power of the system. In a conventional engine, in which the cooling fluid is always in circulation, the use of a sensor of the temperature of the cooling fluid may be sufficient to have a good operation of the system. On the contrary, in an engine in which a pump is provided which is adapted to be deactivated, i.e. in which under determined operating conditions the cooling fluid is not circulating (such as during warm-up after a cold start), the use of a sensor of the temperature of the metal body of the engine insures a much faster and reliable response of the system. The same applies also to an engine of conventional type, when it is considered that during transient operating conditions, such as those due to an abrupt increase of the engine load, the temperature of the metal body of the engine increases much more promptly and therefore provides a much more reliable signal for controlling the cooling system.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
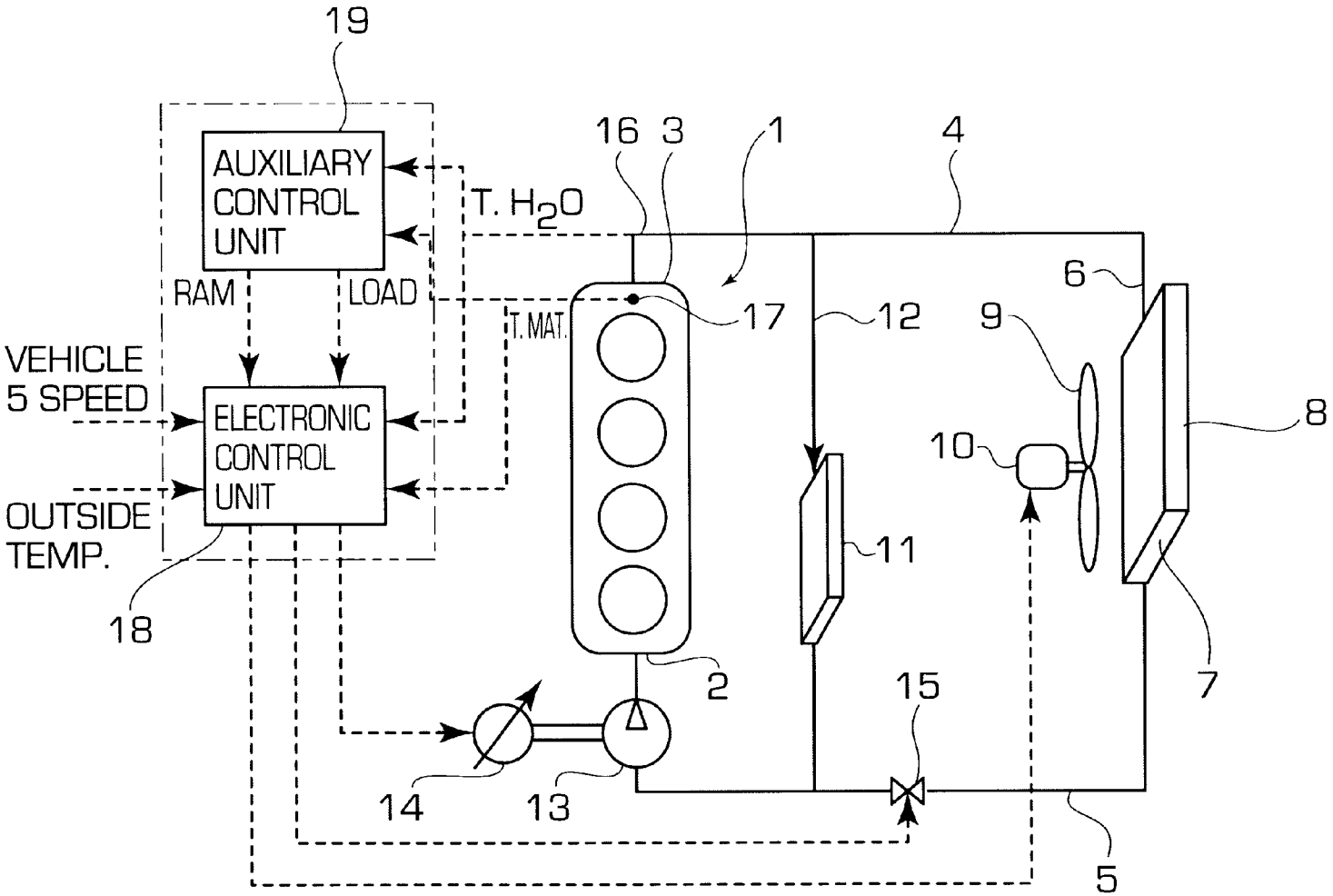
FIG. 1 is a diagram of the cooling system according to the invention.

In FIG. 1, reference numeral 1 diagrammatically designates an engine through which a cooling circuit is provided having an inlet 2 and an outlet 3 connected by conduits 4, 5 to the inlet 6 and the outlet 7 of a radiator 8 of conventional type. With radiator 8, also according to the conventional art, there is associated a fan 9 driven by a motor and reducing gear unit 10. The example illustrated in the drawing shows also a heat exchanger 11 for the heating of the vehicle compartment, through which a conduit 12 is arranged in parallel with radiator 8. The circulation of the cooling fluid within the circuit is activated by a pump 13 which, in the case of the illustrated example, is driven by an electric motor 14 at an adjustable speed. In the conduit 5 there is further interposed a valve 15 for regulating the flow of the cooling fluid to the radiator 8.

The system according to the invention is adapted to be used particularly with cooling systems in which the pump 13 is a pump adapted to be regulated (such as an electrically driven pump as already described above) which can be activated in specific operating conditions of the engine (such as during warm-up after a cold start) in order to optimize the operation of the engine. However, the invention is also applicable to cooling systems of convention type in which the cooling fluid is constantly in circulation through the circuit.

According to the main feature of the invention, with the cooling circuit there is associated also a sensor 16 of the temperature of the cooling fluid (as usually provided in the conventional cooling systems) as well as at least one sensor 17 of the temperature of the metal body of the engine. This sensor is preferably provided adjacent to the combustion chamber of an engine cylinder and for instance can be of the NTC type ("Negative Temperature Coefficient"). The signal emitted by sensors 16, 17 is sent to an electronic control unit 18 which attends accordingly to controlling the electric motor 14 driving the pump 13 (in the case of the illustrated example which makes use of an electrically driven pump), the regulating valve 15, and the electric motor 10 driving the fun 9.

Preferably, the same signals coming from sensors 16, 17 are also used by an auxiliary control unit 19 for controlling the fuel injection and the engine ignition. The main electronic control unit 18 also receives signals indicative of the outside temperature, the speed of the car, the rotational speed of the engine and the engine load, as diagrammatically shown in FIG. 1.

As already discussed above, the provision of sensor means for the temperature of the metal body of the engine provides a more prompt response of the cooling system to the variation of the engine operating condition. This is particularly apparent in a cooling system which makes use of a pump which can be deactivated, in which the cooling fluid is not always circulating.

Figure 2:
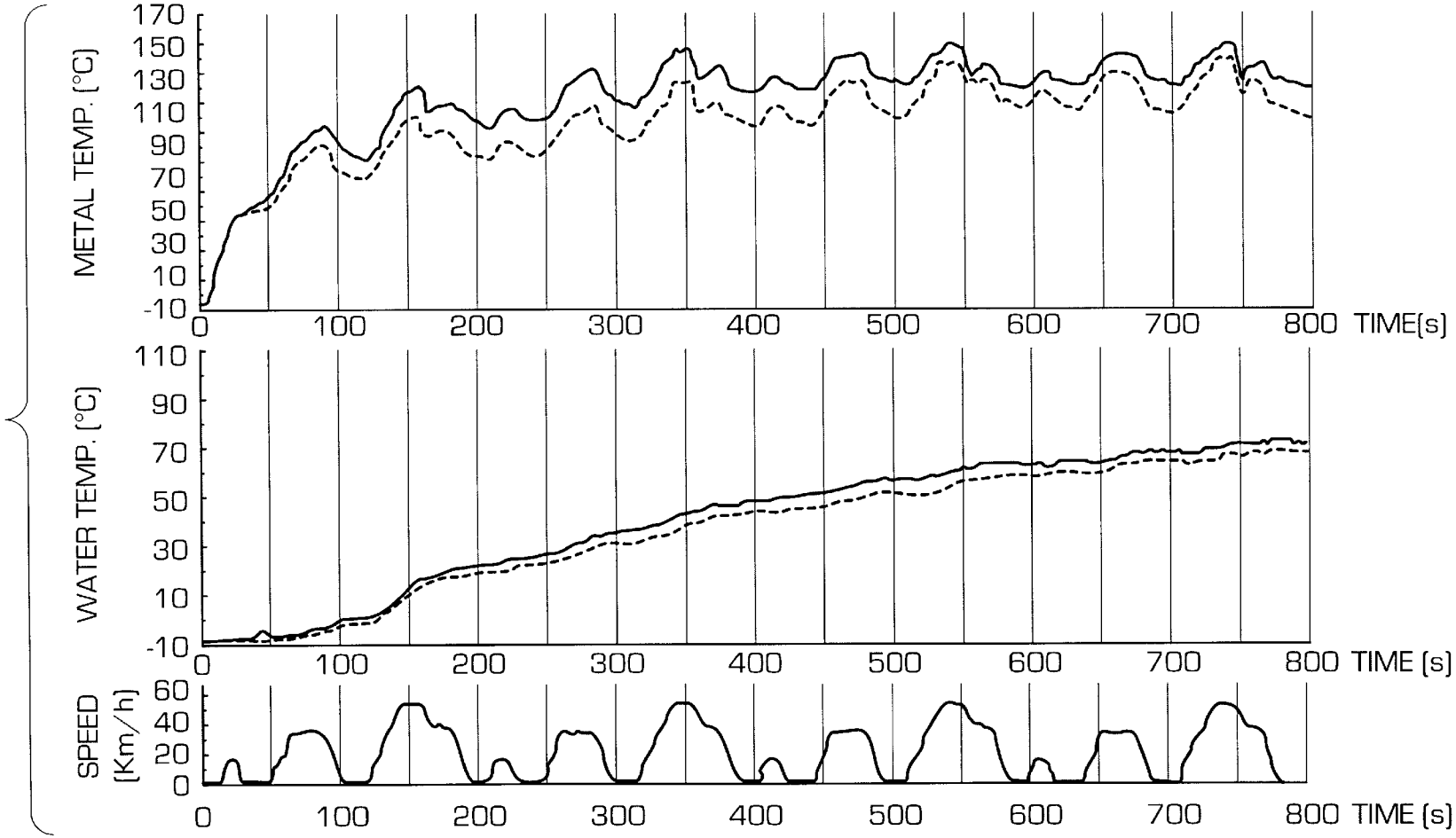
FIG. 2 shows diagrams explaining the advantages of the system according to the invention.

The advantages of the invention will become apparent from an analysis of the diagrams shown in FIG. 2. In this figure, the lowermost diagram shows a possible variation of the motor-vehicle speed with time. As shown, the diagram refers to a test including subsequent acceleration and deceleration cycles. The diagram located in central position in FIG. 2 shows the variation of the temperature of the cooling fluid during the speed variations shown in the lower diagram. The central diagram has two lines, one undotted and the other dotted, which respectively relate to a cooling system making use of an electrically driven pump and a pump mechanically connected to the engine. As shown, in both cases the temperature of the cooling fluid does not have variation similar to those of the speed of the vehicle, because of the inertia with which the cooling fluid varies its temperature during the variations of the engine operating conditions.

The uppermost diagram of FIG. 2 shows the variation of the temperature of the metal body of the engine, again in the two cases of electrically driven pump and mechanically driven pump. As shown, in this case the temperature of the metal body undergoes variations which substantially faithfully follow the corresponding variations of the motor-vehicle speed. This means that the signal coming from the sensor for the temperature of the metal body of the engine provides much more prompt response to the variations of the engine operating condition. Therefore, by controlling the cooling system on the basis of this signal, better results are obtained with respect to the conventional systems.

From the foregoing description, it is clearly apparent that the essential feature of the present invention lies in providing, in addition to the conventional sensors for the temperature of the cooling fluid, at least one sensor for the temperature of the engine metal body, whose signal is used as a basis both for controlling the heating status of the engine, and for controlling the fuel injection and the engine ignition.

Naturally, while the principle of the invention remains the same, the details of construction and the embodiments may widely vary with respect to what has been described and illustrated purely by way of example, without departing from the scope of the present invention.

What is claimed is:

1. Cooling system for a motor-vehicle internal combustion engine, comprising:

a circuit for circulation of a cooling fluid through the engine, a radiator, conduit means for directing the cooling fluid coming out of the engine to the radiator and from the latter to the inlet of the engine cooling circuit, a pump interposed in said conduit means for circulating the engine cooling fluid, temperature sensor means associated with the engine cooling circuit comprising at least one sensor for sensing the temperature of the cooling fluid, means for regulating the flow of the cooling fluid through the radiator, and control means for controlling said regulating means on the basis of the signal coming from said sensor means, wherein said temperature sensor means further comprise at least one sensor for sensing the temperature of the metal body of the engine and said control means are adapted to control the fuel injection and the engine ignition on the basis of the signals coming from said sensor means for sensing the temperature of the engine cooling fluid and the temperature of the engine metal body.

2. System according to claim 1, wherein said regulating means comprise a valve for regulating the flow of the cooling fluid interposed in the said conduit means.

3. System according to claim 1, wherein said pump is adapted to be deactivated during operation of the engine.

4. System according to claim 3, wherein said pump is driven by an electric motor.

5. System according to claim 4, wherein said electric motor is adjustable in speed.

6. System according to claim 1, wherein said control means comprise a first electronic control unit adapted to control said regulating means and a second electronic control unit adapted to control the fuel injection and the engine ignition, said electronic control units being adapted to carry out said controlling operations on the basis of the signals coming from said temperature sensor means and a number of sensors including one or more of the following sensors: a sensor of the engine speed, a sensor of the engine load, a sensor of the outside temperature, a sensor of the motor-vehicle speed.

* * * * *